US009120113B2

(12) United States Patent
Hotta et al.

(10) Patent No.: US 9,120,113 B2
(45) Date of Patent: Sep. 1, 2015

(54) SURFACE TREATING APPARATUS

(71) Applicant: C. Uyemura & Co., Ltd., Osaka (JP)

(72) Inventors: Teruyuki Hotta, Osaka (JP); Hisamitsu Yamamoto, Osaka (JP); Masayuki Utsumi, Osaka (JP); Takahiro Ishizaki, Osaka (JP)

(73) Assignee: C. UYEMURA & CO., LTD., Osaka (JP)

( * ) Notice: Subject to any disclaimer, the term of this patent is extended or adjusted under 35 U.S.C. 154(b) by 13 days.

(21) Appl. No.: 13/951,947

(22) Filed: Jul. 26, 2013

(65) Prior Publication Data

US 2014/0053774 A1 Feb. 27, 2014

(30) Foreign Application Priority Data

Aug. 27, 2012 (JP) ..... 2012-186448

(51) Int. Cl.

| | |
|---|---|
| ***B05C 3/00*** | (2006.01) |
| ***B05C 3/09*** | (2006.01) |
| ***B05C 11/11*** | (2006.01) |
| ***B05B 15/12*** | (2006.01) |
| ***B05C 5/00*** | (2006.01) |
| *B08B 3/04* | (2006.01) |

(52) U.S. Cl.

CPC ..... *B05C 3/09* (2013.01); *B05B 15/1207* (2013.01); *B05C 3/00* (2013.01); *B05C 5/002* (2013.01); *B05C 11/11* (2013.01); *B08B 3/041* (2013.01); *Y10T 137/8593* (2015.04)

(58) Field of Classification Search

USPC ..... 118/423, 426, 428, 429; 204/198

See application file for complete search history.

(56) References Cited

U.S. PATENT DOCUMENTS

| | | | | |
|---|---|---|---|---|
| 3,876,510 | A * | 4/1975 | Wallin et al. | 205/73 |
| 2007/0108044 | A1 * | 5/2007 | Okuda et al. | 204/198 |

FOREIGN PATENT DOCUMENTS

| | | | |
|---|---|---|---|
| JP | 2002363796 | A * | 12/2002 |
| JP | 2004-339590 | | 12/2004 |
| JP | U 3115047 | | 9/2005 |
| JP | 2006-118019 | | 5/2006 |
| JP | 2010-189736 | | 9/2010 |
| JP | 2011-032538 | | 2/2011 |

OTHER PUBLICATIONS

English Translation JP-2004-339590, Dec. 2, 2004.*

* cited by examiner

*Primary Examiner* — Yewebdar Tadesse

(74) *Attorney, Agent, or Firm* — Jason H. Vick; Sheridan Ross, PC

(57) ABSTRACT

A tank body 100 includes a liquid receiving part 2 for receiving processing solution Q applied to a plate-like work 10 and a liquid retaining part 4 for retaining liquids to be applied to the plate-like work 10 and a liquid outflowing part 6 for causing a flow of the processing solution Q which is spilled out of the liquid retaining part 4 and traveled down toward the plate-like work 10, wherein a tip 6*a* of the liquid outflowing part 6 is projected from a connecting part 5 connecting to the liquid retaining part 4 (or the liquid receiving part 2).

7 Claims, 20 Drawing Sheets

SURFACE TREATING APPARATUS

CROSS REFERENCE TO RELATED APPLICATIONS

This application claims the benefit under 35 U.S.C. 119 (a) to Japanese Patent Application No. JP 2012-186448 filed Aug. 27, 2012, the entire disclosure of which is incorporated herein by reference in its entirety.

FIELD OF THE INVENTION

The present invention relates to a technique for electroless plating a plate-like such as a printed circuit board.

BACKGROUND ART

Description of Background Art (i) Conventionally, as shown in FIG. 16, electroless plating process was carried out by dipping plural works 10 housed in a rack into processing solution Q accumulated in a tank (JP-A-2011032538). Here, unlike electroplating that energization is carried out, electroless plating is a plating method that enable to plate merely by dipping a treatment object into plating solution. By means of electroless plating, it becomes possible to plate even if it is a non-conductor (insulators such as plastic, ceramics, etc.).

(ii) As shown in FIG. 17, there is an electrolytic plating apparatus (JP-B-3115047U) to prevent the plate-like work 10 from contacting with side walls W1, W2 by causing a vertical flow of the processing solution Q and shaking the plate-like work 10 inside of a tank V comprising side walls W1, W2 arranged close to a plate-like work 10. Also, there is an electrolytic plating apparatus (JP-A-2006118019, JP-A-2004339590) to attract the plate-like work 10 into the processing solution Q smoothly by pouring the processing solution Q downwardly through a tapered aperture from above the tank V when the plate-like work 10 is falling.

(iii) Additionally, there is other technique to making an impact on a work for draining off liquid by making a protruding object on the guide rail for transporting hanger and climbing over the protruding object when transporting (See FIG. 6 of JP-A-2010189736).

Description of Problems to be Solved by the Invention (i) The technique shown in FIG. 16 of JP-A-2011032538 requires the rise-and-fall mechanism for dipping the lack. This results in causing a problem that facility for electroless plating gets more complex and larger. Also, this results in causing a problem that a mass of processing solution is required, because it is needed to dip into the electroless plating processing solution Q stored in a tank.

(ii) If the techniques of JP-B-3115047U, JP-A-2006118019, JP-A-2004339590 are adopted for electroless plating, the processing solution Q might be running down the side walls W1, W2 inside of tank V. This result in causing a problem that desired quality of plating is not achieved. Also, this result in causing a problem that a mass of processing solution is required.

(iii) Additionally, the technique shown in JP-A-2010189736 is temporarily making an impact on the treatment object when passing over a difference in level. Therefore, it is not possible to drain off liquid surely.

SUMMARY OF THE INVENTION (1) A surface treating apparatus of this invention includes: a transport hanger for transporting a treatment object; a tank body for attaching processing solution to the treatment object which is transported by the transport hanger interiorly; and a transport mechanism for transporting the transport hanger into the tank body, in which the tank body includes a liquid receiving part for receiving the processing solution applied to the treatment object and a liquid retaining part placed at a position higher than the liquid receiving part for retaining liquids to be applied to the treatment object and a liquid outflowing part for causing a flow of the processing solution which is spilled out of the liquid retaining part and traveled down toward the treatment object, wherein a tip of the liquid outflowing part is projected from a connecting part connecting to the liquid retaining part or the liquid receiving part.

This makes it possible to perform electroless plating by applying appropriate quantities of the processing solution to the plate-like work with the use of the projected part. Therefore, quality of plating can be improved and amount of the processing solution can be reduced.

(2) The surface treating apparatus of this invention is characterized by including a guide rail for transporting the transport hanger in a nearly horizontal direction, wherein the transport hanger is controlled by a control part so as to move back and forth a predetermined number of times on an impact generator arranged on the guide rail.

This makes it possible to remove attaching bubbles by making an impact on a plate-like work.

(3) The surface treating apparatus of this invention is characterized by including a guide rail for transporting the transport hanger in a nearly horizontal direction, wherein the transport hanger is controlled by a control part so as to move on plural impact generators arranged on the guide rail.

This makes it possible to remove attaching bubbles by making an impact on a plate-like work.

(4) The surface treating apparatus of this invention is characterized by including plural guide rails for transporting the transport hanger in a nearly horizontal direction, wherein the transport hanger is fixed to a support member suspended between plural guide rails.

This makes it possible to reduce vibration of the plate-like work, and also possible to reduce distortion of structural objects (such as a frame, etc.) which support the transport mechanism.

(5) The surface treating apparatus of this invention is characterized that the surface treating apparatuses are adjacently arranged in plural rows perpendicular to the direction of transport, the guide rail is shared between adjacent surface treating apparatuses.

This makes it possible to increase productivity, while downsizing the surface treating apparatus.

(6) The surface treating apparatus of this invention is characterized that the liquid receiving part and the liquid retaining part are connected through a circulation pump.

This makes it possible to reduce the total amount of the processing solution used for the surface treating apparatus.

(7) The surface treating apparatus of this invention is characterized that the liquid receiving part has a cutout vertically-extended on its side wall and the treatment object passes through the cutout when the transport hanger is transferred, and the processing solution are supplied to the liquid retaining part so that liquid level of the processing solution stored in the liquid receiving part is located below lower end of the cutout.

This makes it possible to prevent the processing solution Q stored in the receiving part 2 from spilling out from cutout of the liquid receiving part.

(8) A tank body of this invention includes: a liquid retaining part for retaining liquids, a liquid outflowing part for causing a flow of the processing solution spilled out of the liquid retaining part and traveled down toward the treatment object, in which a tip of the liquid outflowing part is projected from connecting part connecting to the liquid retaining part.

This makes it possible to perform electroless plating by applying appropriate quantities of the processing solution to the plate-like work with the use of the projected part. Therefore, quality of plating can be improved.

(9) The surface treating apparatus or tank body of this invention is characterized by including the tank body includes a liquid receiving part for receiving the processing solution applied to the treatment object, and the liquid receiving part has a cutout vertically-extended on its side wall and the treatment object passes through the cutout when the transport hanger is transferred.

This makes it possible to perform a series of electroless plating process merely by transferring the transport hanger in a horizontal direction. Therefore, a structure of the apparatus can be simplified and minimized because the rise-and-fall mechanism is not required, etc.

(10) The surface treating apparatus or tank body of this invention is characterized in that the liquid receiving part has a side wall that the cutout is formed at a distance from both ends of the liquid outflowing part.

This makes it possible to prevent the processing solution from spilling out of slit.

(11) The surface treating apparatus or tank body of this invention is characterized in that a tip of the liquid outflowing part is installed at a slant in a nearly horizontal direction or lower than the horizontal direction from connecting part connecting to the liquid retaining part or the liquid receiving part.

This allows the processing solution spilled out of the liquid retaining part to outflow from a tip of the projected part toward the plate-like work.

(12) The surface treating apparatus or tank body of this invention is characterized in that the liquid outflowing part has grooves extended toward the treatment object on upper surface.

This makes it possible to prevent the processing solution spilled out of the liquid retaining part from aggregating near the center of the projected part due to surface tension. Therefore, it is possible to apply uniform amount of the processing solution to the plate-like work.

(13) The surface treating apparatus or tank body of this invention is characterized in that the grooves are formed in a shape so that flow rate of the processing solution near the both ends are higher than near the center at tip of the liquid outflowing part.

This makes it possible to apply uniform amount of the processing solution to the plate-like work in consideration of aggregating near the center of the projected part due to surface tension, while the processing solution applied to the plate-like work is running down the plate-like work.

(14) The surface treating apparatus or tank body of this invention is characterized in that plural stages of the liquid outflowing mechanism comprising the liquid retaining part and the liquid outflowing part are arranged inside of the tank body.

This makes it possible to apply a desired quantity of the processing solution to the plate-like work from the projected part located at plural stages.

(15) A tank body of this invention includes: a liquid retaining part for retaining liquids, a flow down member for flowing processing solution spilled out of the liquid retaining part down, and a liquid receiving part for receiving the processing solution applied to the treatment object; in which the liquid receiving part has a cutout vertically-extended on its side wall and the treatment object passes through the cutout when the transport hanger is transferred, and the liquid receiving part has a side wall that the cutout is formed at a distance from both ends of the liquid outflowing part.

This allows the processing solution spilled out of the liquid retaining part to outflow from a tip of the projected part toward the plate-like work.

It would be understood that other objects, uses and effects of the invention are obvious to those skilled in the art with reference to the drawings and descriptions below.

DETAILED DESCRIPTION OF DESIRED EMBODIMENTS

1. Structure of Surface treating apparatus 300

Figure 1:
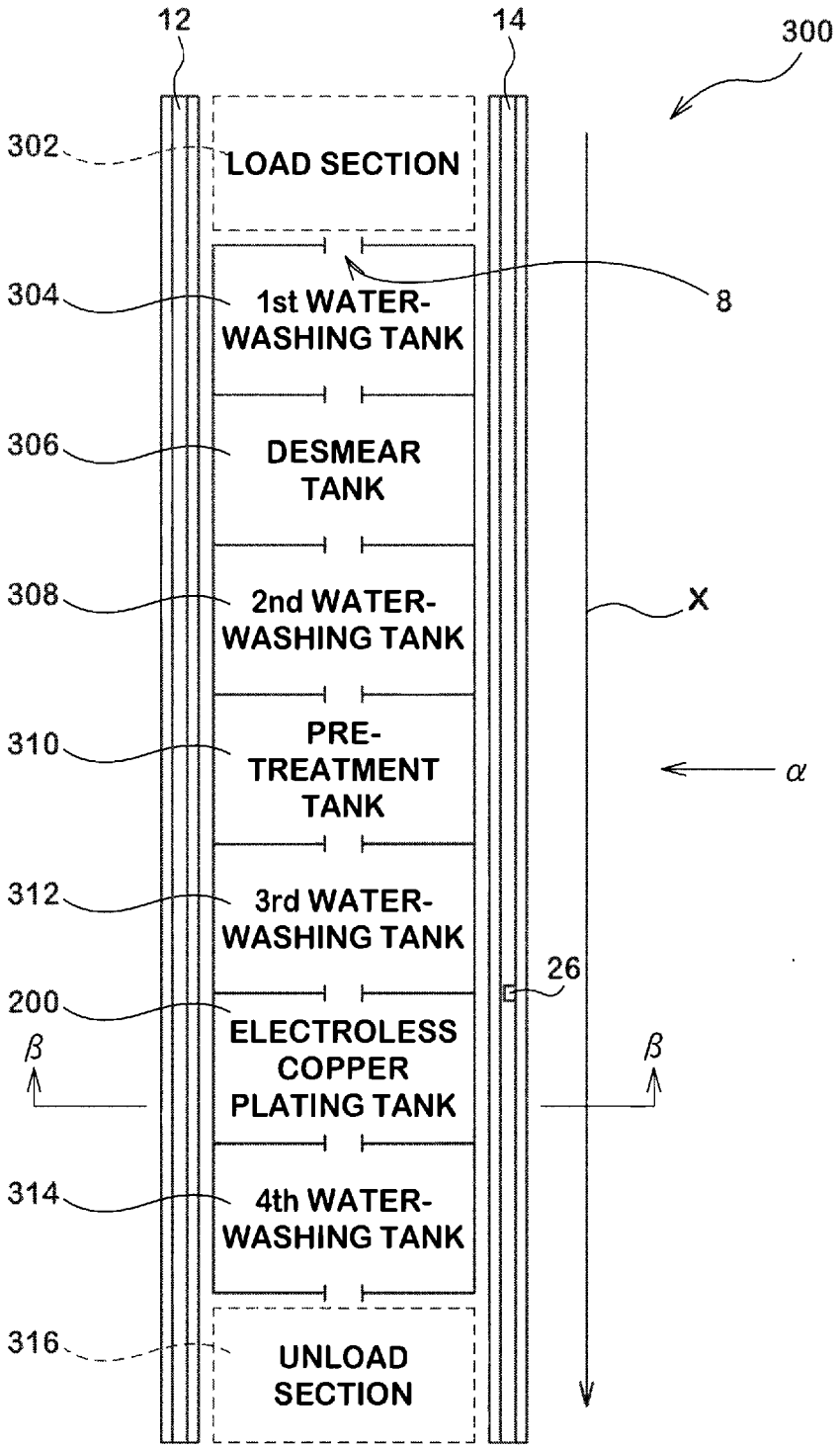
FIG. 1 is an arrangement plan of a surface treating apparatus 300 seen from above.
Figure 2:
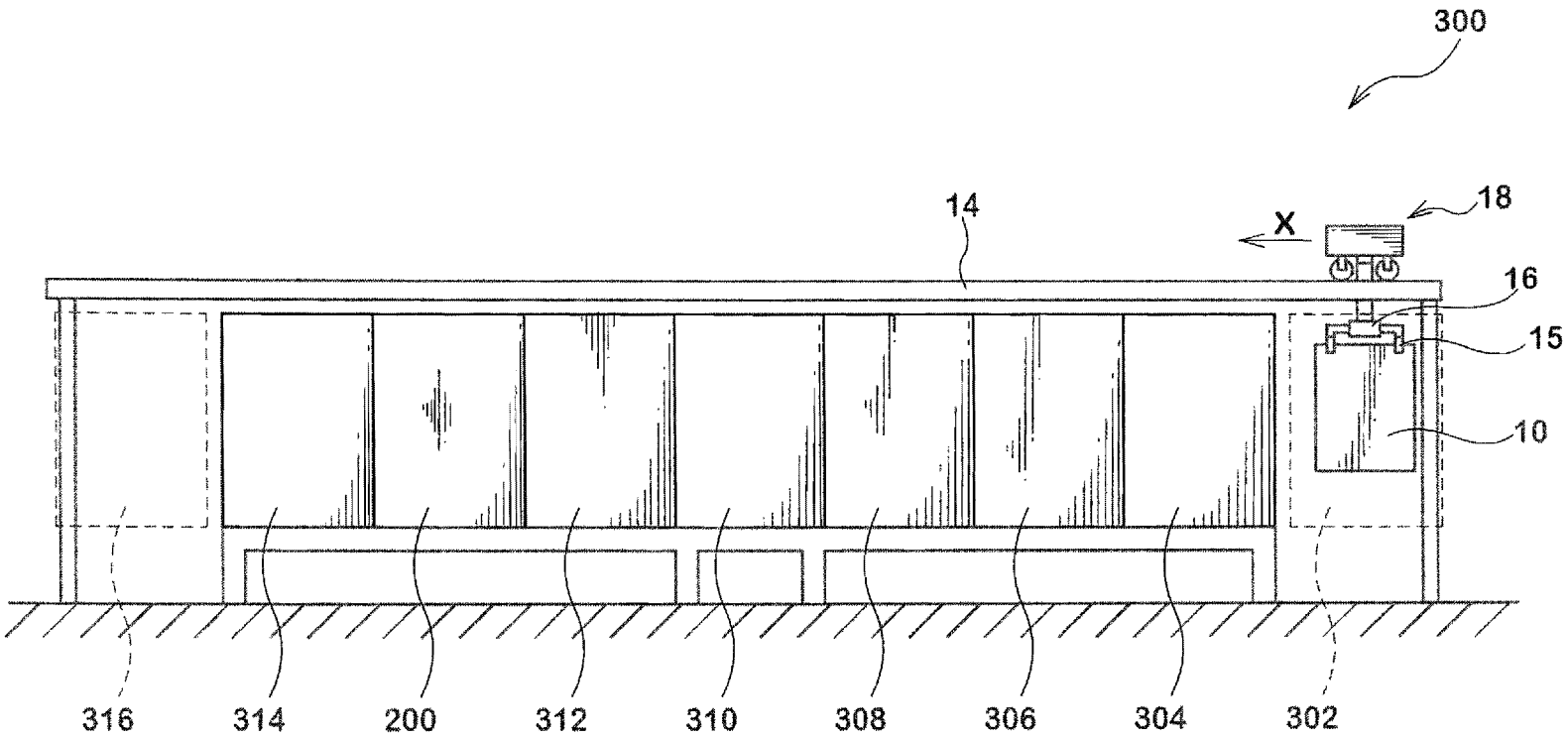
FIG. 2 is a side view of the surface treating apparatus 300 seen from α direction.

First, a structure of a surface treating apparatus 300 of the present invention will be described with reference to FIGS. 1 and 2. FIG. 1 is an arrangement plan of a surface treating apparatus 300 seen from above. FIG. 2 is a side view of the surface treating apparatus 300 shown in FIG. 1 seen from α direction. In FIG. 1, a transport hanger 16 and a transport mechanism 18 shown in FIG. 2 are omitted.

As shown in FIG. 1, along the transport direction X of a plate-like work 10 (FIG. 2) as a treatment object, the surface treating apparatus 300 includes a load section 302, a 1st water-washing tank 304, a desmear tank 306, a 2nd water-washing tank 308, a pre-treatment tank 310, a 3rd water-washing tank 312, an electroless copper plating tank 200, a 2nd water-washing tank 314, and an unload section 316 arranged in sequence. Each process for electroless copper plating is performed in this order. Each tank has cutout(s) 8 (FIG. 1) forming a passage of transport hanger 16 shown in FIG. 2. In addition, each process will hereinafter be described in detail.

Further, the surface treating apparatus 300 includes the transport hanger 16 for transporting the plate-like work 10 clamped by clamp 15 shown in FIG. 2, and the transport mechanism 18 for transporting the transport hanger 16. FIG. 2 indicates a state that plate-like work 10 is attached to the transport hanger 16 at a load section 302.

After the plate-like work 10 is attached at a load section 302, the transport mechanism 18 starts to move in the horizontal direction X, thereby the plate-like work 10 pass through inside of each tank (electroless copper plating tank 200, etc.). Eventually, the transport mechanism 18 stops at the unload section 316, and the plate-like work 10 that plating has been performed is detached from the transport hanger 16.

Figure 3:
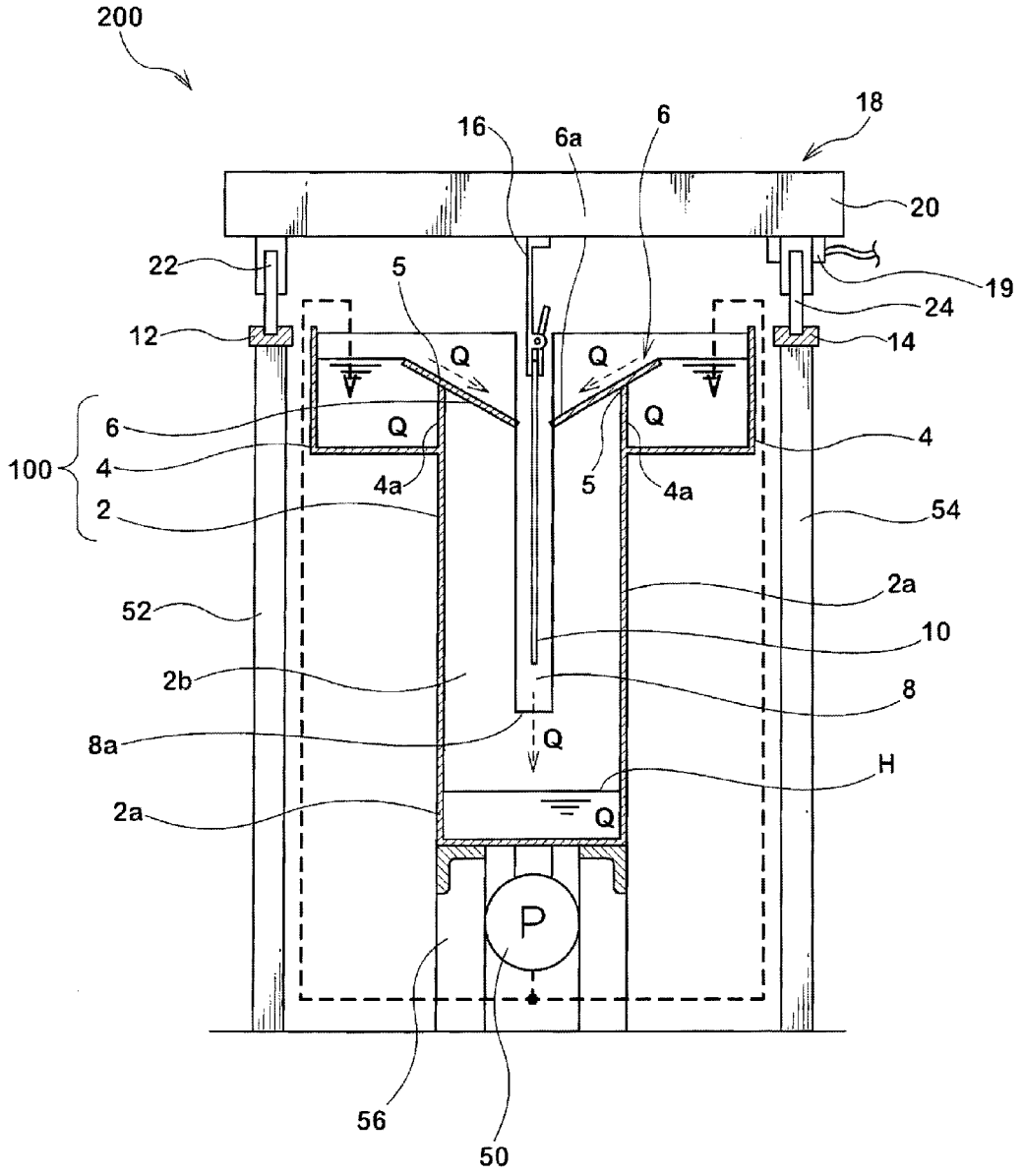
FIG. 3 is a cross-sectional view taken along the line 13-13 of an electroless copper plating tank 200 that forms apart of the surface treating apparatus 300.
Figure 4:
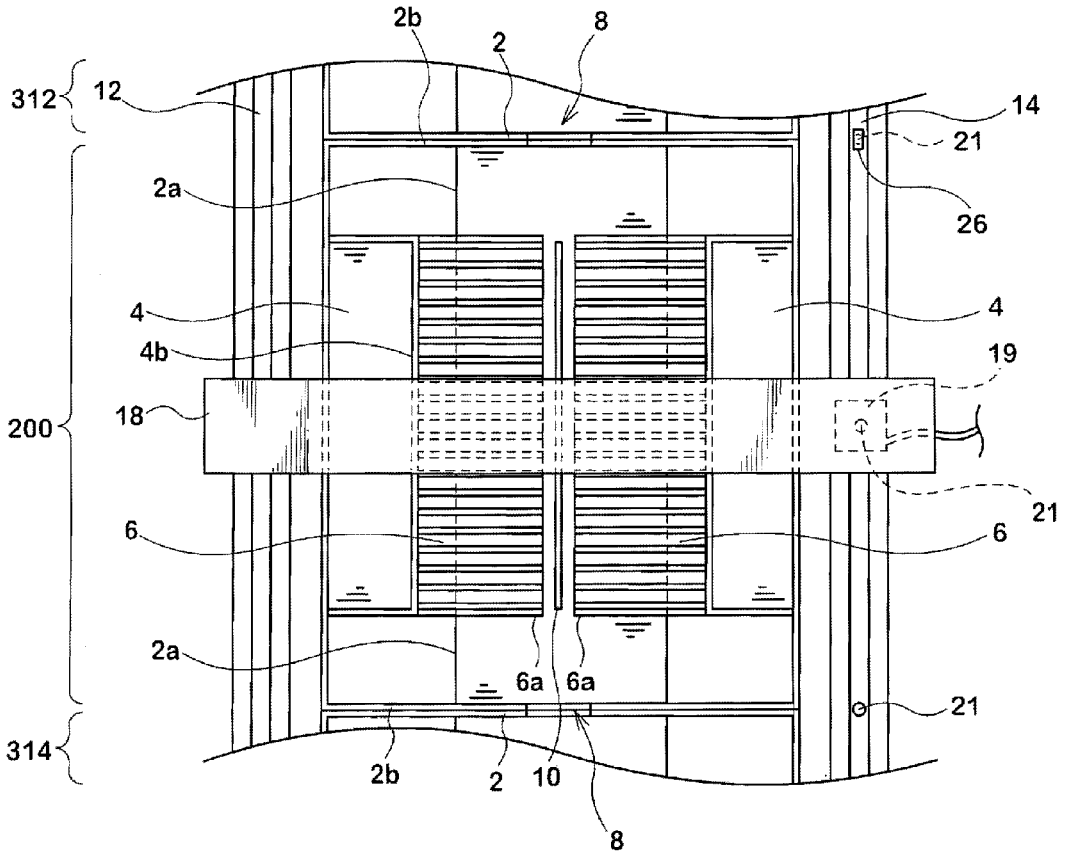
FIG. 4 is a view of the electroless copper plating tank 200 seen from above.

FIG. 3 is a cross-sectional view taken along the line β-β of the electroless copper plating tank 200 (FIG. 1) that forms a part of the surface treating apparatus 300. FIG. 4 is a view of the electroless copper plating tank 200 shown in FIG. 3 seen from above. FIGS. 3 and 4 indicate a state when the transport hanger 16 and the transport mechanism 18 have been reached inside of the electroless copper plating tank 200(FIG. 1 and FIG. 2).

The electroless copper plating tank 200 shown in FIG. includes a tank body 100 mounted on the frame 56, a circulation pump 50 for circulating the processing solution Q (electroless copper plating solution) inside of the tank body 100.

The tank body 100 includes a liquid receiving part 2 for receiving the processing solution Q which has been running down the plate-like work 10, a liquid retaining part 4 for retaining liquids to be applied to the plate-like work 10, and a liquid outflowing part 6 for causing a flow of the processing solution Q which is spilled out of the liquid retaining part 4 and traveled down toward the plate-like work 10. As shown in FIG. 3, a tip 6*a* of the liquid outflowing part 6 is projected from a connecting part 5 connecting to the side wall 4*a* of the liquid retaining part 4 (or the side wall 2*a* of the liquid receiving part 2). Inside of this tank body 100, the processing solution Q (electroless copper plating solution) is applied to the plate-like work 10 clamped by the transport hanger 16.

Thus, a system is employed that circulated processing solution Q runs down the plate-like work 10 without dipping the plate-like work 10 into stored processing solution Q in FIG. 3. This makes it possible to reduce the total amount of the processing solution Q used for the surface treating apparatus 300.

The transport mechanism 18 includes the guide rails 12, 14, a support member 20, and the transport rollers 22, 24.

At the bottom of the support member 20 shown in FIG. 3, the transport rollers 22, 24 are installed for movement of the transport mechanism 18 on the guide rails 12, 14. The transport rollers 22, 24 are powered by a motor (not shown). Each of guide rails 12, 14 are fixed on the frames 52, 54.

As shown in FIG. 3, the transport hanger 16 is fixed below the support member 20 so as to be suspended between two guide rails 12, 14. This makes it possible to reduce a vibration of the plate-like work 10, and also possible to reduce a distortion of structural objects (such as guide rails 12 and 14, frames 52 and 54, etc.) which support the transport mechanism 18.

Also, the plural magnets 21 are embedded at a predetermined location on the guide rails 12, 14 shown in FIG. 4. The transport mechanism 18 has a magnetic sensor 19 for detecting the magnet 21 on the guide rails 12, 14. The magnetic sensor 19 is installed on the lower side of the support member (one place of the guide rail 14's side).

This allows the transport hanger 16 transported into the electroless copper plating tank 200 to stop at a predetermined location (for example, at the center position of the electroless copper plating tank 200 shown in FIG. 4).

As shown in FIG. 3, the circulation pump 50 installed for each tank is connected to the bottom of the liquid receiving part 2, as indicated by the dotted arrow, the liquid receiving part 2 and the liquid retaining part 4 are connected through the circulation pump 50. This makes it possible to provide the liquid retaining part 4 with the processing solution Q accumulated in the bottom of the liquid receiving part 2 again by means of circulation pump 50.

As shown in FIG. 4, side wall 2*b* of the liquid receiving part 2 is arranged at a distance from both sides of the liquid outflowing part 6 that has a cutout 8 which forms a passage of the plate-like work 10 and the transport hanger 16. It is because to prevent the processing solution Q from leaking through the slit 8.

[Structure of Tank Body 100]

Figure 5:
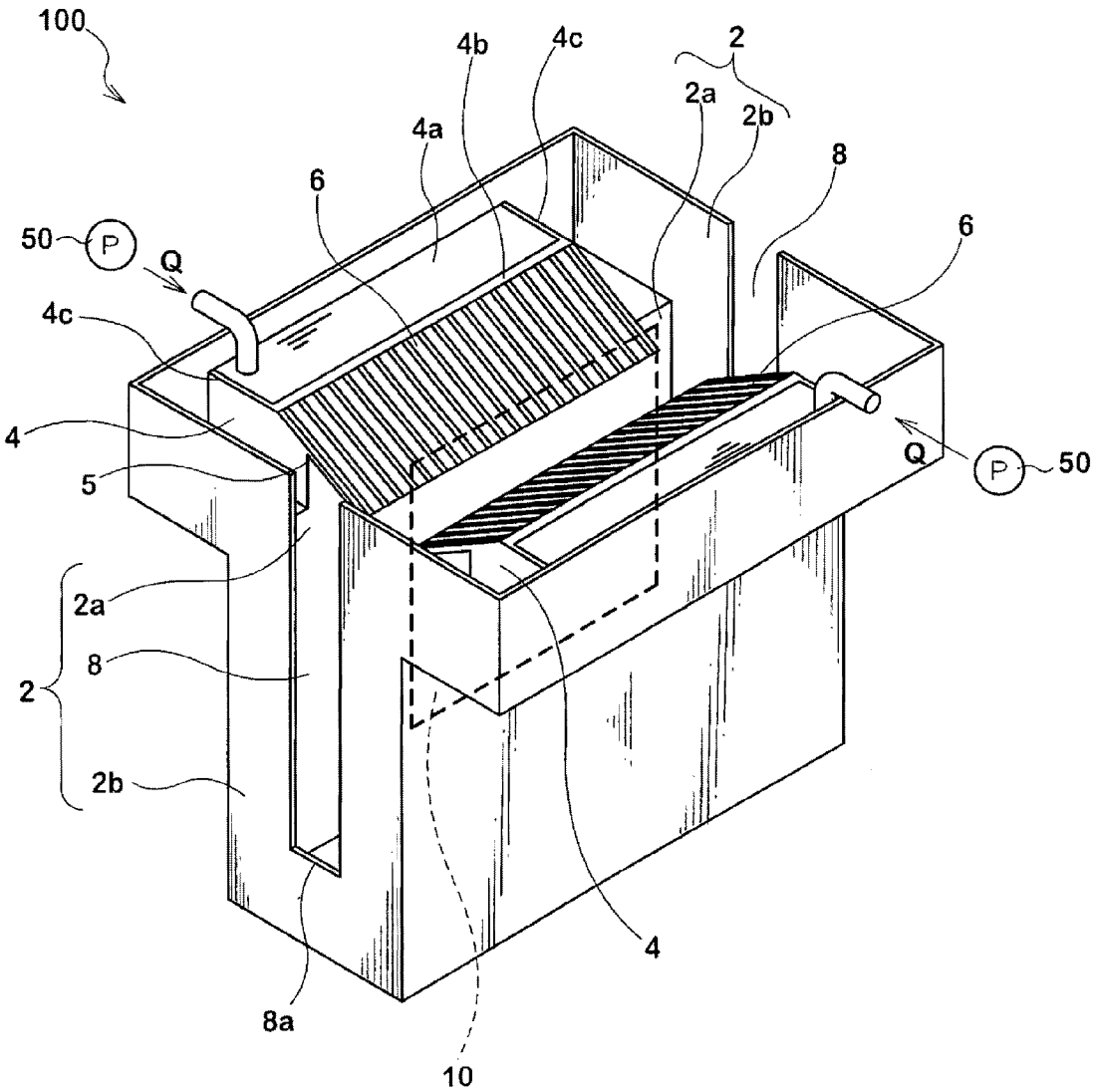
FIG. 5 is a perspective view of a tank body 100 used for the electroless copper plating tank 200, etc.

FIG. 5 is a perspective view of the tank body 100. The tank body 100 is also used for each tank other than the electroless copper plating tank 200 shown in FIG. 1. Each tank has the same structure, while varied types of the processing solution (plating solution, desmear solution, washing water, etc.) being used. It is the only difference.

As described above, the tank body 100 includes the liquid receiving part 2, the liquid retaining part 4, and the liquid outflowing part 6. Those maybe formed as an integrated member by fabricating members made of such as PVC (polyvinyl chloride) which is manufactured, adhered, etc.

The liquid receiving part 2 includes a container-shaped member for receiving processing solution below which is applied to the plate-like work 10 as a treatment object (shown as the dotted line in FIG. 5) . The side wall 2*a* of the liquid receiving part 2 (the same face with side wall 4*a* of the liquid retaining part 4) is connected to the liquid outflowing part 6 at the connecting part 5.

The liquid retaining part 4 is formed as a container-shaped member to retain the processing solution Q being applied to the plate-like work 10, and is placed at a position higher than the liquid receiving part 2. To retain the processing solution Q being provided, the liquid retaining part 4 has a space inside. There is an aperture 4*a* on the upper side.

When the processing solution Q is constantly provided and a liquid level of the processing solution Q that has been provided is beyond the aperture 4*a* of the liquid retaining part 4, it becomes an overflow state. Then, the processing solution Q spills out from the long fringe 4*b* toward the liquid outflowing part 6. Besides, the processing solution Q spilled out from both of the short fringes 4*c* will be provided with the liquid retaining part 4 by means of the circulation pump 50 after it is dropped into the liquid receiving part 2.

The liquid outflowing part 6 includes the plate-like member connected to long fringe 4*b* of the liquid retaining part 4 at end so that processing solution Q spilled out of the liquid retaining part 4 travels down toward the plate-like work 10.

As shown in FIG. 3, tip 6*a* of the liquid outflowing part 6 is projected from the connecting part 5 connecting to side wall 4*a* of the liquid retaining part 4 (or side wall 2*a* of the liquid receiving part 2) toward the plate-like work 10. This makes it possible to prevent the processing solution Q from running down the side wall 2*a* of the liquid receiving part 2.

Furthermore, to outflow the processing solution Q from tip 6*a* of the liquid outflowing part 6 swiftly, the liquid outflowing part 6 and tip 6*a* of the liquid outflowing part 6 is installed at a slant in a lower direction than the horizontal direction from side wall 2*a* of the liquid receiving part 2.

Figure 6A:
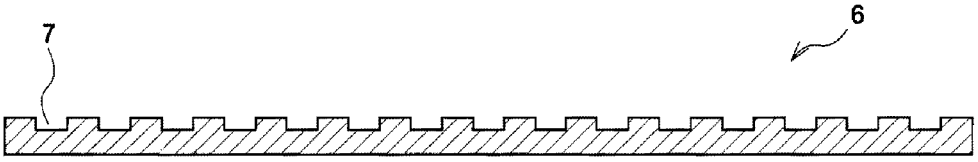
FIG. 6A shows a cross-sectional shape of a liquid outflowing part 6.

FIG. 6A shows a cross-sectional shape of the liquid outflowing part 6. As shown in FIG. 6A, a number of grooves 7 are formed at predetermined distance on the upper surface of the liquid outflowing part 6 that are extended in parallel to the direction toward the plate-like work 10 (shown as dotted line in FIG. 5). The reason why grooves 7 are formed on the liquid outflowing part 6 is to prevent the processing solution Q spilled out of the liquid retaining part 4 from aggregating near the center of the liquid outflowing part 6 due to surface tension. For example, the depth of groove 7 is 1 1 mm, the width is 2 mm, and the arranging interval is 2 mm.

Figure 6B:
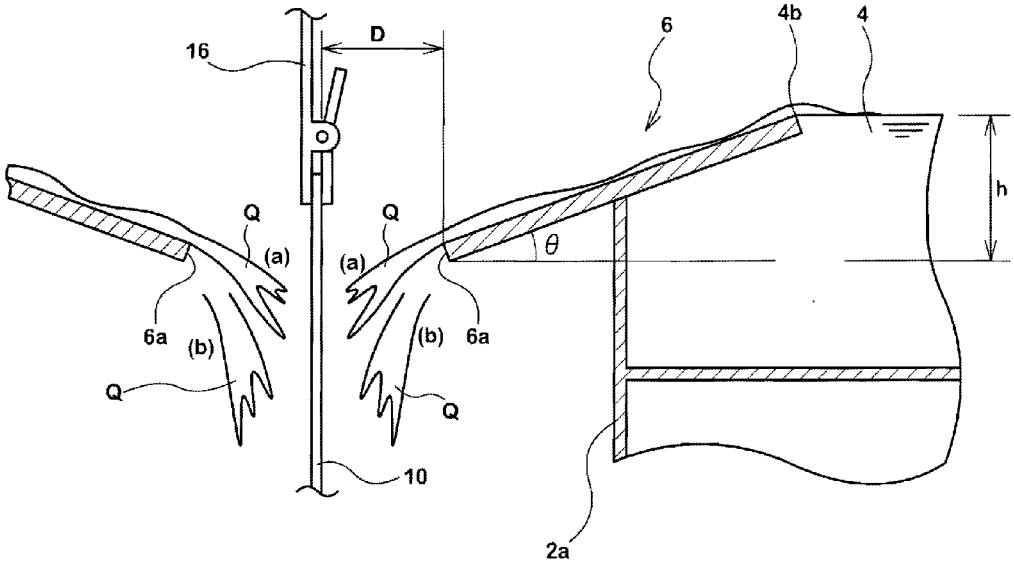
FIG. 6B is a cross-sectional view of a status of the processing solution Q flowing out from tip 6*a* of the liquid outflowing part 6.

By adopting such a structure, the processing solution Q can be spilled out from long fringe 4*b* of the liquid retaining part 4 in an overflow state of the liquid retaining part 4 as shown in FIG. 6B, and also it can be travelled down the liquid outflowing part 6 so as to outflow toward the plate-like work 10. In addition, by outflowing from tip 6*a* of the liquid outflowing part 6, the processing solution Q is directly applied to both sides (one side and the other side) of the plate-like work 10. Accordingly, it is achieved that quality improvement of electroless plating process performed inside of the electroless copper plating tank 200 and reduction of processing solution being used, and so on.

The area of the plate-like work 10 where the processing solution Q is applied to varies according to conditions such as distance D shown in FIG. 6B from tip 6*a* of the liquid outflowing part 6 to the plate-like work 10, angle e of the liquid outflowing part 6 (outflow angle against the horizontal direction), difference h on height between an aperture 4*a* (long fringe 4*b*) of the liquid retaining part 4 and the tip 6*a* of the liquid outflowing part 6, etc. Namely, if the distance D is too big, the outflow angle e is too big, or the difference h on height is too small, there is a possibility that the processing solution Q does not hit the plate-like work 10 (flow(b) shown in FIG. 6B).

On the other hand, if the distance D between the plate-like work 10 and tip 6*a* of the liquid outflowing part 6 is too small, there are possibilities that the plate-like work 10 contacts with the liquid outflowing part 6 during transporting, or the processing solution Q remains between the plate-like work 10 and the liquid outflowing part 6. Also, if the outflow angle θ is too small, or the difference h on height is too small, there are possibilities that it causes a problem such as bubble generation on impact when hitting the plate-like work 10. Therefore, as indicated as a flow (a) in FIG. 6B, the distance D to the plate-like work 10, the outflow angle θ, the difference h on height are designed so that the processing solution Q is applied to the desired position in desired momentum. For example, the angle θ of the liquid outflowing part 6 (outflow angle against the horizontal direction) is preferably ranging from 30 to 60 degrees against the horizontal direction, especially preferably 45 degrees against the horizontal direction.

Also, the liquid receiving part 2 has a slit 8 as a cutout which is vertically formed on its side wall 2*b* shown in FIG. 5. This allows the plate-like work 10 to pass through the slit 8 when the transport hanger 8 is transported. If lower end 8*a* of the slit 8 is too low, the processing solution Q accumulated in the liquid receiving part 2 might be overflowed and flowed to the exterior.

Therefore, it is required to adjust supplied amount of the processing solution Q so that the liquid level H (FIG. 3) of the processing solution Q to be used, that is accumulated in the liquid receiving part 2, is constantly placed at a position lower than lower end 8*a* of the slit 8. In this embodiment, such a problem is resolved so that the liquid level H (FIG. 3) of the processing solution Q to be used, that is accumulated in the liquid receiving part 2, is constantly placed at a position lower than lower end 8*a* of the slit 8, by determining the amount of the processing solution Q to be used and connecting the liquid receiving part 2 and the liquid retaining part 4 through a circulation pump 50.

2. Each Processing in the Surface Treating Apparatus 300

Referring to FIG. 7 etc., each process of the surface treating apparatus 300 will be described. In this embodiment, the processing solution Q used for each tank of the surface treating apparatus 300 is constantly circulated by the circulation pump 50 in each tank.

Figure 7A:
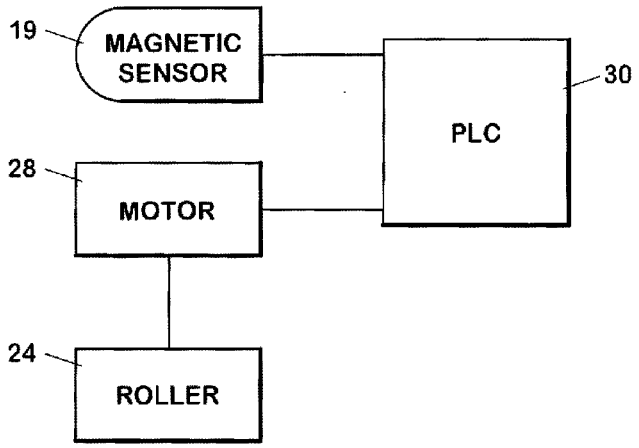
FIG. 7A shows a relation of connection for controlling of transferring movement of a transport mechanism 18.

FIG. 7A shows a relation of connection for controlling transferring movement of the transport mechanism 18. As shown in FIG. 7A, the magnetic sensor 19(FIG. 4) is connected to PLC 30, and detects that it is arrived above the magnet which is arranged on the guide rail 14. A signal that the magnetic sensor 19 has been detected is carried to PLC 30. After receiving a signal, PLC 30 controls movements (forward, backward, stop, etc.) of the transport rollers 22, 24 by switching on/off the motor 28.

At first, at the load section 302 shown in FIG. 1, an operator or an installation device (not shown) attaches a plate-like work 10 to be plated to the transport hanger 16 (a state shown in FIG. 2).

Then, as the operator push a transport switch (not shown), the transport hanger 16 moves into the 1st water-washing tank 304 along the guide rails 12, 14. That is, PLC 30 controls transport rollers 22, 24 so as to move forward by switching on the motor 28.

Next, at the 1st water-washing tank 304, water-washing process is performed by applying water to the plate-like work 10 from both sides. The transport hanger 16 stops at the 1st water-washing tank 304 for a predetermined time, then, moves into the desmear tank 306.

For example, after receiving a signal from the magnetic sensor 19 that indicates an arrival at the center of the water-washing tank 304, PLC 30 controls the motor 28 so as to stop for one minute. Then, PLC 30 controls transport rollers 22, 24 so as to move forward by switching on the motor 28. Also, similar control is performed at the 2nd water-washing tank 308, the 3rd water-washing tank 312, and the 4th water-washing tank 314.

At the desmear tank 306, the transport hanger 16 stops for a predetermined time (for example, five minutes), and desmear processing solution (swelling conditioner, resin etching solution, neutralizing solution, etc.) is applied to the plate-like work 10 from both sides. Here, the desmear process is a process to remove smear (resin) which remains on the plate-like work 10 upon machining such as making a hole, etc.

For example, after receiving a signal from the magnetic sensor 19 that indicates an arrival at the center of the desmear tank 306, PLC 30 controls the motor 28 so as to stop for five minutes. Then, transport rollers 22, 24 move forward by switching on the motor 28. Similar process is performed at the pre-treatment tank 310.

Next, at the 2nd water-washing tank 308, water-washing process is performed by applying water to the plate-like work 10 from both sides. The transport hanger 16 stops at the 2nd water-washing tank 308 for a predetermined time (for example, 1 minute), then, moves into the pre-treatment tank 310.

At the pre-treatment tank 310, the transport hanger 16 stops for a predetermined time (for example, 5 minutes), and the pre-treatment solution is applied to the plate-like work 10 from both sides.

Next, at the 3rd water-washing tank 312, water-washing process is performed by applying water to the plate-like work 10 from both sides. The transport hanger 16 stops at the 3rd water-washing tank 312 for a predetermined time (for example, 1 minute).

Then, until arriving at the electroless copper plating tank 200 (FIGS. 3 and 4), it repeats the back and forth movement a predetermined number of times as mentioned below. The processing solution Q may not be reached to the plate-like work 10 because air (bubble) remains there, if there are holes such as through holes, etc. on the plate-like work 10. Therefore, it is required to remove air (bubble) before performing an electroless copper plating process.

Figure 7B:
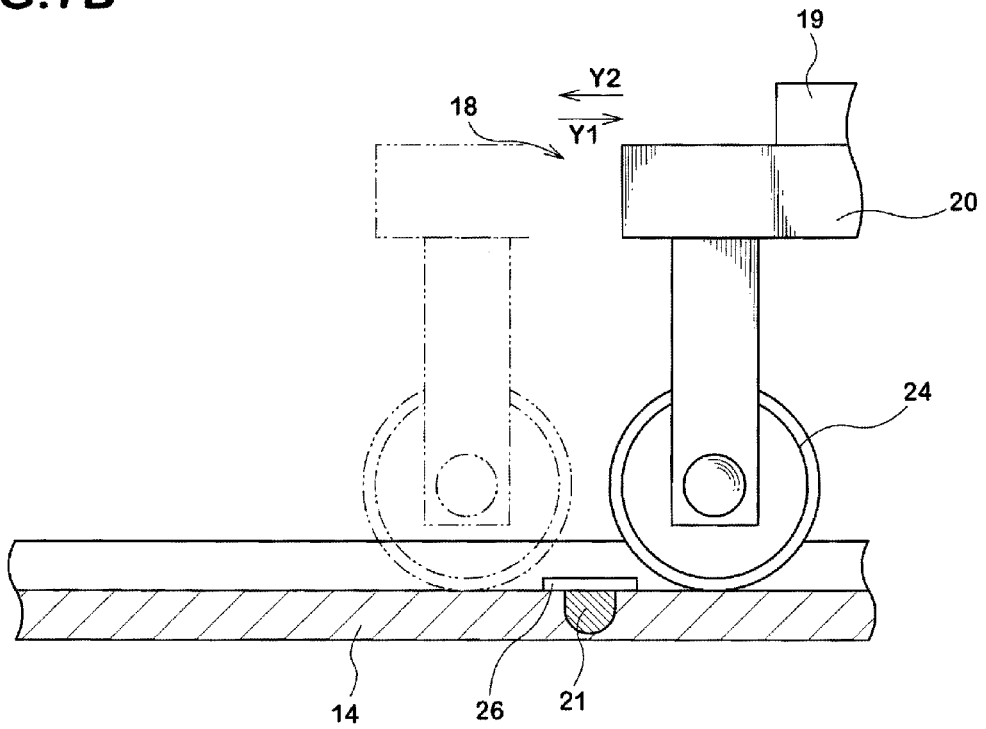
FIG. 7B shows a cross-section surface of a guide rail 14 between the 3rd water-washing tank 312 and the electroless copper plating tank 200.

FIG. 7B shows a cross-section surface of the guide rail 14 between the 3rd water-washing tank 312 and the electroless copper plating tank 200 (FIG. 1). As shown in FIGS. 7B and 1, one convex part 26 as an impact generator is formed on the guide rail 14. It is possible to drain off the processing solution Q by an impact caused when the transport roller 24 climbed over this convex part 26.

For example, after receiving a signal which indicates that the magnet 21 shown in FIG. 7B is arrived at the center (that is, the convex part 26 is climbed over by the transport roller 24), PLC 30 controls the motor 28 so that the transport rollers 22, 24 move backward a predetermined distance (Y1 direction shown in FIG. 7B). Then, the transport rollers 22, 24 move forward until detecting the magnet 21 (Y2 direction shown in FIG. 7B). After repeating the above-mentioned back and forth movement a predetermined number of times (for example, 3 times back and forth), it stops at the center of the electroless copper plating tank 200 (FIG. 4).

The transport hanger 16 stops for a predetermined time in the electroless copper plating tank 200, and electroless copper plating solution is applied to the plate-like work 10 from both sides.

For example, PLC 30 brings the motor 28 to a halt for 5 minutes after receiving a signal from the magnetic sensor 19 that indicates the arrival at the center of the electroless copper plating tank 200. Then, the transport rollers 22, 24 move forward by switching on the motor 28.

Then, at the 4th water-washing tank 314, a water-washing process is performed by applying water to the plate-like work 10 from both sides. The transport hanger 16 stops at the 4th water-washing tank 314 for a predetermined time (for example, 1 minute), after that, it is transferred to the unload section 316.

At last, the transport hanger 16 transferred to the unload section 316 stops. For example, PLC 30 brings the motor 28 to a halt after receiving a signal from the magnetic sensor 19 that indicates the arrival at the unload section 316. After that, the plate-like work 10 is unloaded by the operator, etc. In this way, a series of the electroless plating process will be completed.

3. Two stages of Liquid Outflowing Mechanism (Liquid Retaining Part 4 and Liquid Outflowing Part 6)

Figure 8:
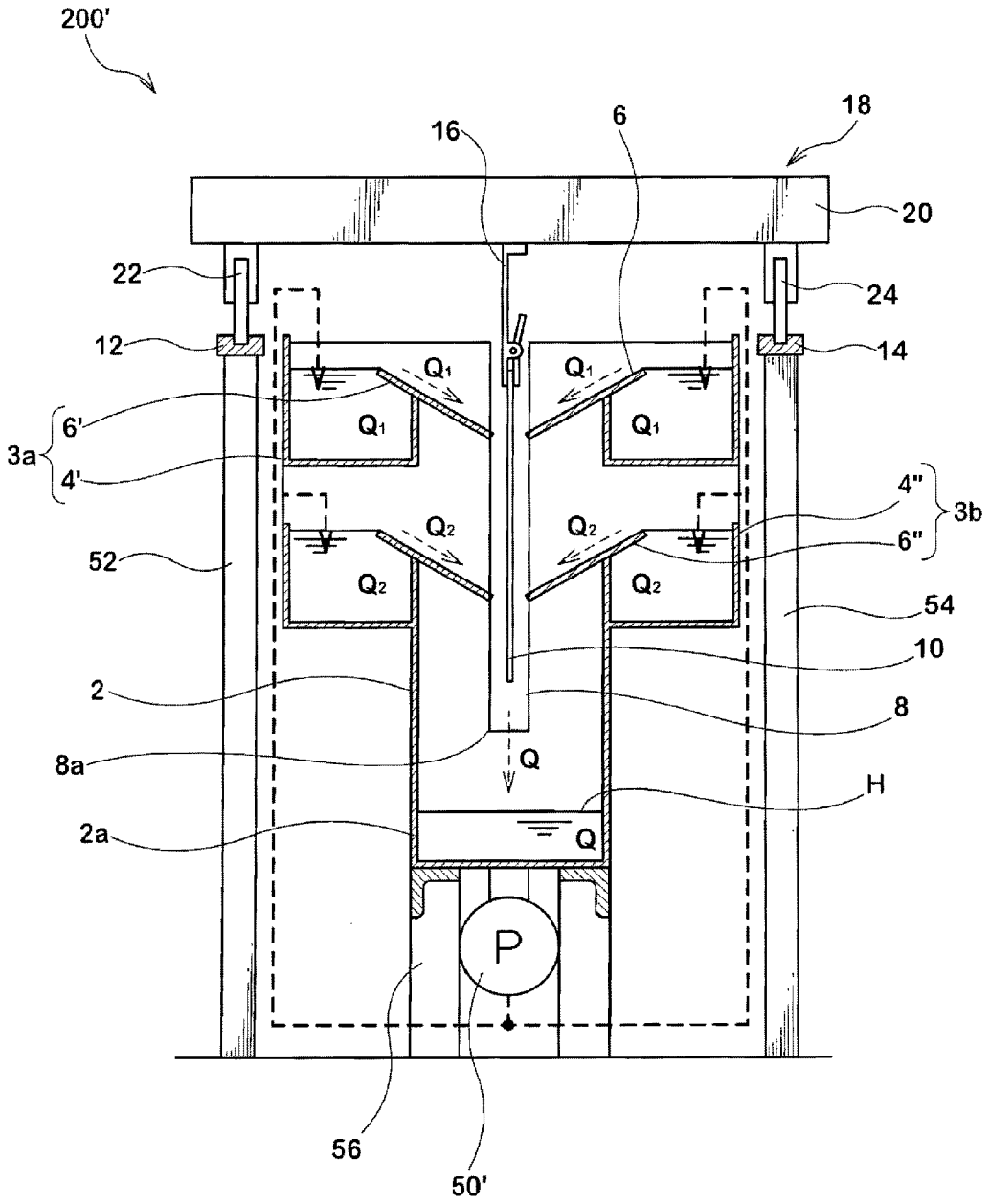
FIG. 8 shows an electroless copper plating tank 200' which has two stages of liquid outflowing mechanism (upper stage liquid outflowing mechanism 3*a*, lower stage liquid outflowing mechanism 3*b*).

In the above embodiments, a single liquid outflowing mechanism (FIG. 3) including the liquid retaining part 4 and the liquid outflowing part 6 is arranged inside of the tank body 100. However, liquid outflowing mechanism may be arranged as plural stages. FIG. 8 shows an example of the electroless copper plating tank 200' which has two stages of the liquid outflowing mechanism arranged in a vertical direction (the upper liquid outflowing mechanism and the lower liquid outflowing mechanism).

As shown in FIG. 8, it is possible to apply the processing solution Q1 to the upper area of the plate-like work 10 by means of the upper liquid outflowing mechanism 3*a*, and it is possible to apply the processing solution Q2 to the lower area by means of the lower liquid outflowing mechanism 3*b*.

Figure 9A:
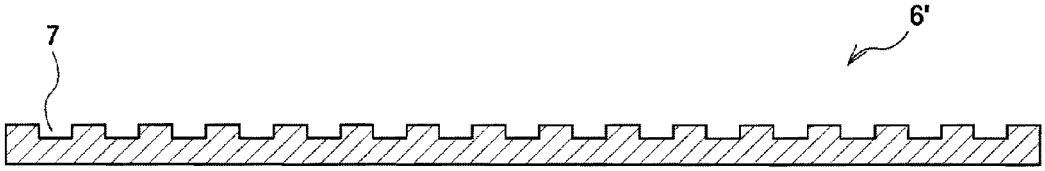
FIG. 9A shows a cross-sectional shape of the liquid outflowing part 6' on the upper stage of the electroless copper plating tank 200'.
Figure 9B:
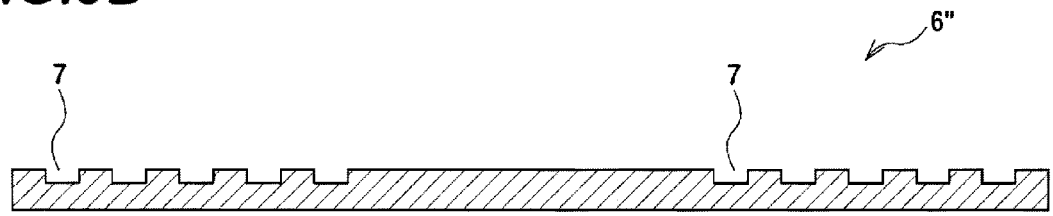
FIG. 9B shows a cross-sectional shape of the liquid outflowing part 6" on the lower stage of the electroless copper plating tank 200'.

FIG. 9A shows a cross-sectional shape of the liquid outflowing part 6' on the upper stage of the electroless copper plating tank 200', and FIG. 9B shows a cross-sectional shape of the liquid outflowing part 6" on the lower stage of the electroless copper plating tank 200'.

As shown in FIG. 6A, a number of grooves 7 are formed at a predetermined distance on the upper liquid outflowing part 6' as well as the liquid outflowing part 6. On the other hand, grooves 7 are formed on the lower liquid outflowing part 6" only outside of near the center.

This structure is employed in consideration of aggregating near the center of plate-like work 10 due to surface tension while the processing solution spilled out of the upper liquid outflowing part 6' and applied to the plate-like work 10 is running down the plate-like work 10. That is to say, it is considered that plating quality can be improved by applying more processing solution Q spilled out of the lower liquid outflowing part 6" to near the both ends (area other than near the center) where the processing solution Q has been thinner while running down the plate-like work 10.

In the electroless copper plating tank 200' shown in FIG. 8, the processing solution Q is provide with the upper liquid retaining part 4' and lower liquid retaining part 4" by means of one circulation pump 50'. However, it may be adopted that independent circulation pumps connected to the liquid receiving part 2 for providing the processing solution Q with the upper liquid retaining part 4' and the lower liquid retaining part 4" respectively. This makes it possible to vary the amount of the processing solution Q1, Q2 to be provided by increasing the amount of the processing solution Q1 provided with the upper stage, and by reducing the amount of processing solution Q2 provided with the lower stage according to the circumstances, and so on.

4. Other Embodiment

In the above embodiments, the surface treating apparatus 300 includes plural tanks (such as the 1st water-washing tank 304, the desmear tank 306, the pre-treatment tank 310, the electroless copper plating tank 200, etc. shown in FIG. 1). However, the surface treating apparatus 300 may include at least one tank.

Figure 10:
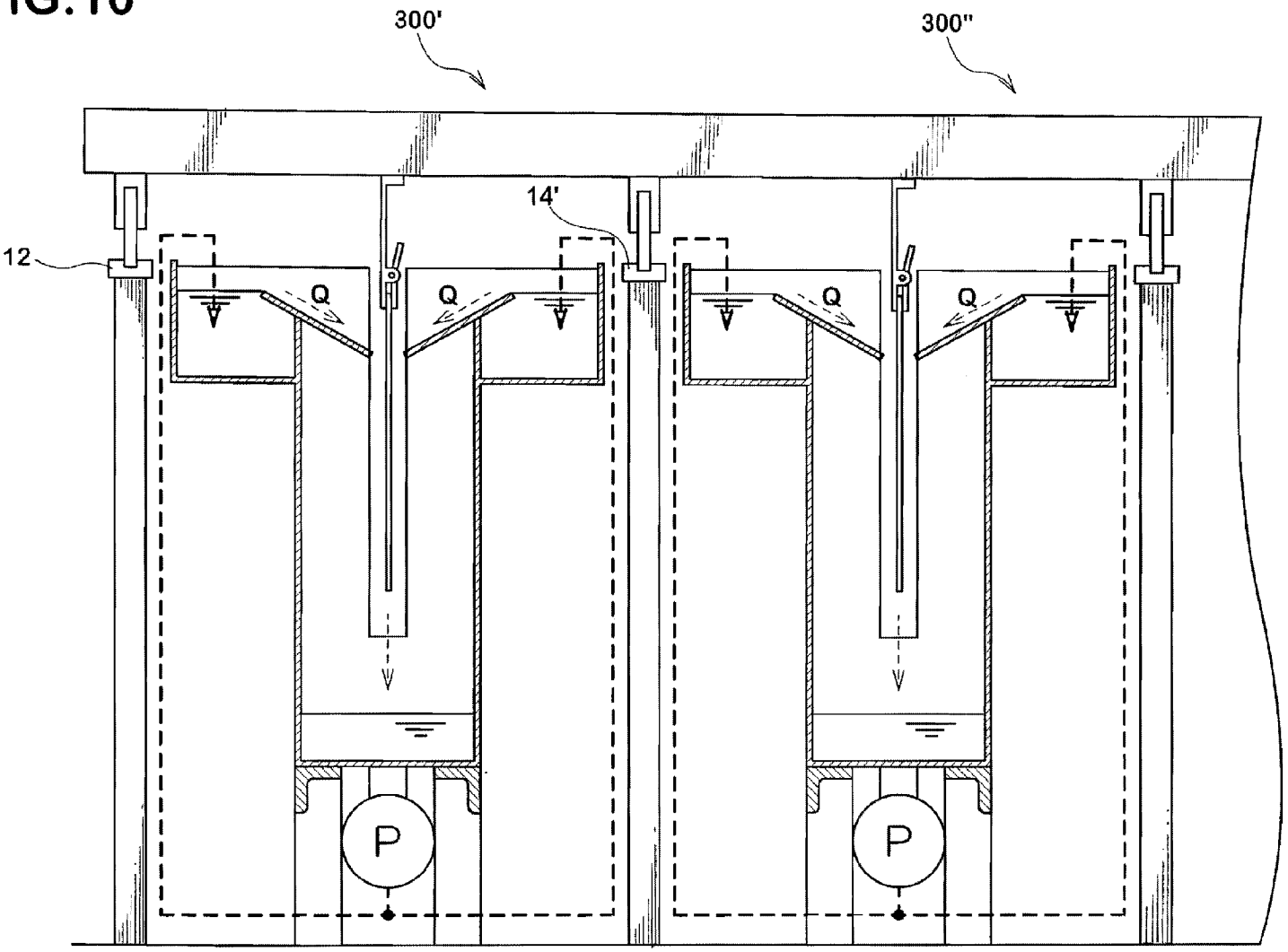
FIG. 10 shows a structure of a surface treating apparatus (adjacently arranged in plural rows) according to another embodiment.

In the above embodiments, the surface treating apparatus 300 is arranged in the direction X of transportation in a row. However, as shown in FIG. 10, the surface treating apparatuses 300', 300" may be adjacently arranged in plural rows. Also, as show in FIG. 10, the guide rail 14' may be shared between these adjacent surface treating apparatuses 300' and 300".

In the above embodiments, plural tanks of the surface treating apparatus 300 are arranged in line. However, plural tanks maybe arranged in a U-shape, a square shape, or a L-shape, etc., by installing a transfer mechanism such as Traverser.

Figure 19:
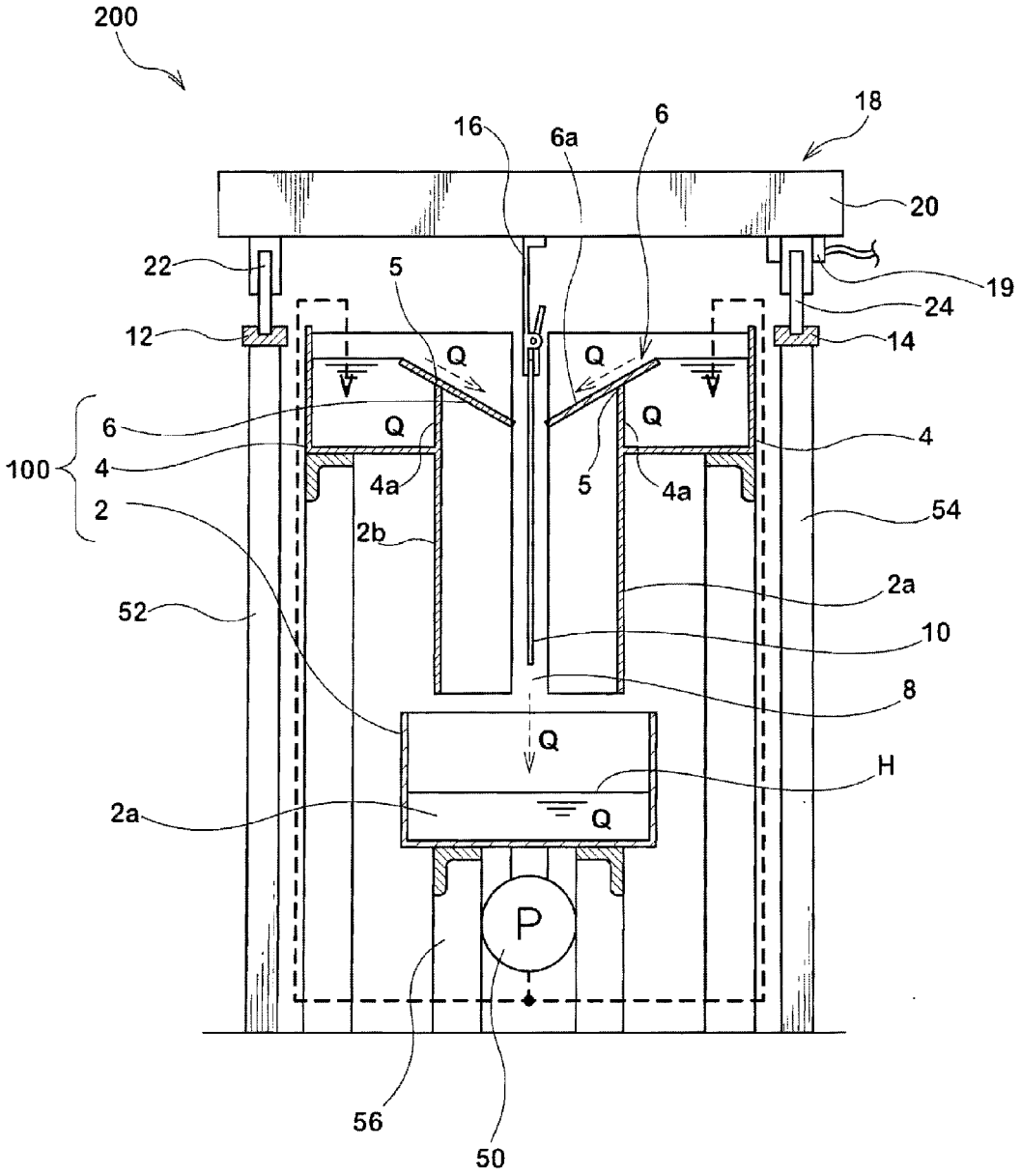
FIG. 19 is a cross-sectional view taken along the line β-β (FIG. 1) of a plating tank 200 according to another embodiment.

In the above embodiments, the liquid receiving part 2, the liquid retaining part 4, and the liquid outflowing part 6 are formed as an integrated member (FIG. 5). However, those maybe separated. For example, as shown in FIG. 19, the liquid receiving part 2 may be separated from the liquid retaining part 4 and the liquid outflowing part 6 (liquid outflowing mechanism).

In the above embodiments, grooves 7 are formed on the entire upper surface of the liquid outflowing part 6 (FIG. 6A). However, grooves 7 maybe formed only outside of near the center of the liquid outflowing part 6 (i.e., near the both ends) (see FIG. 9B). Then, flow rate of the processing solution Q near the tip 6*a* (FIG. 6B) of the liquid outflowing part 6 is uneven, and near the both ends are higher than near the center. Accordingly, this makes it possible to equalize the processing solution Q at a lower level of the plate-like work 10 where the processing solution Q has been running down. Because, the processing solution Q on the plate-like work 10 aggregates near the center due to surface tension while running down the plate-like work 10.

Figure 11A:
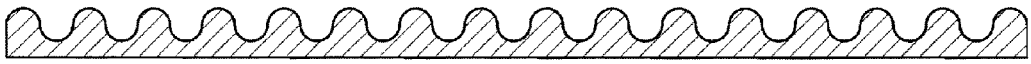
FIGS. 11A and 11B show a cross-sectional shape of grooves 7', 7" according to another embodiment.
Figure 11B:
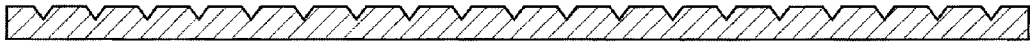

In the above embodiments, rectangular grooves 7 are formed on the upper surface of the liquid outflowing part 6 (FIG. 6A). However, other shaped grooves may be formed such as round-shaped grooves shown in FIG. 11A, and triangular grooves shown in FIG. 11B, and so on.

In the above embodiments, a tip 6*a* of the liquid outflowing part 6 is installed at a slant from side wall 2*a* of the liquid receiving part 2 to plate-like work 10 to a downward direction than the horizontal direction(FIG. 6B). However, as shown in FIG. 12A, the liquid outflowing part 6 may be pointed in nearly horizontal direction from connecting part 5 (including a little upper direction than horizontal direction).

Figure 12A:
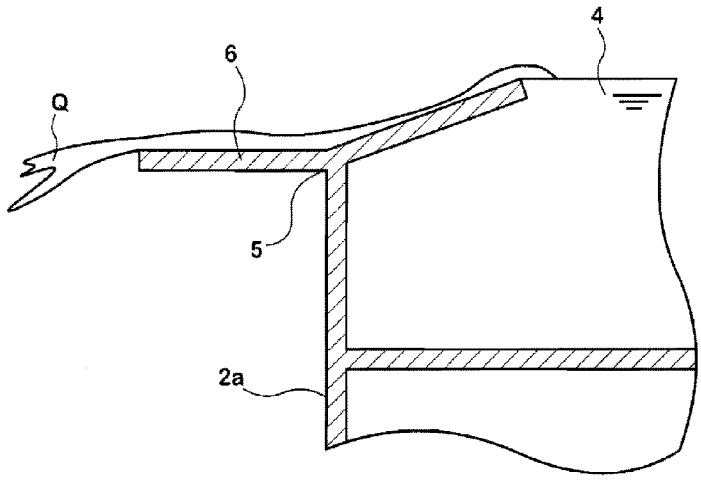
FIGS. 12A-12C show a structure of the liquid outflowing part 6 according to another embodiment.

Even if the liquid outflowing part 6 is pointed in a horizontal direction as shown in FIG. 12A, when its inertial force by outflowing from the liquid retaining part 4 is big enough, the processing solution Q outflows from the tip 6*a* of the liquid outflowing part 6 swiftly.

Figure 12B:
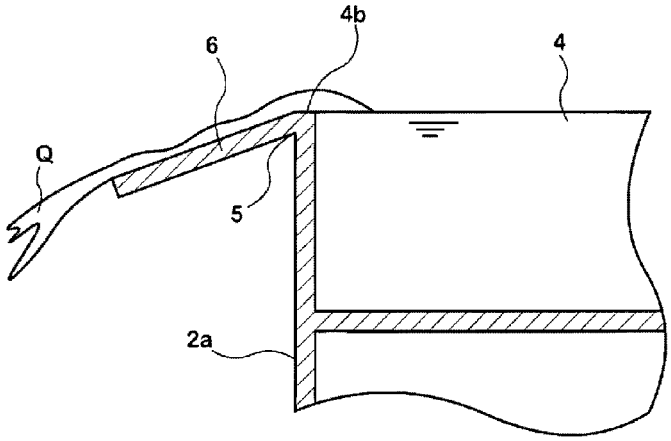

Also, in the above embodiments, the long fringe 4*b* of the liquid retaining part 4 is positioned at a distance from the connecting part 5 (FIG. 6B). However, as shown in FIG. 12B, the long fringe 4*b* of the liquid retaining part 4 may be positioned at the same position with the connecting part 5.

Figure 12C:
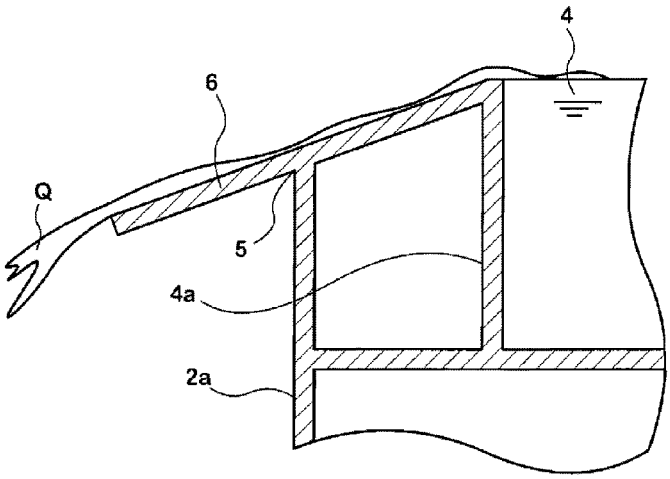

Also, in the above embodiments, side wall 2*a* of the liquid receiving part 2 and side wall 4*a* of the liquid retaining part 4 are formed as the same wall. However, as shown in FIG. 12C, the side wall 4*a* of the liquid retaining part 4 maybe separated from the side wall 2*a* of the liquid receiving part 2.

Figure 13:
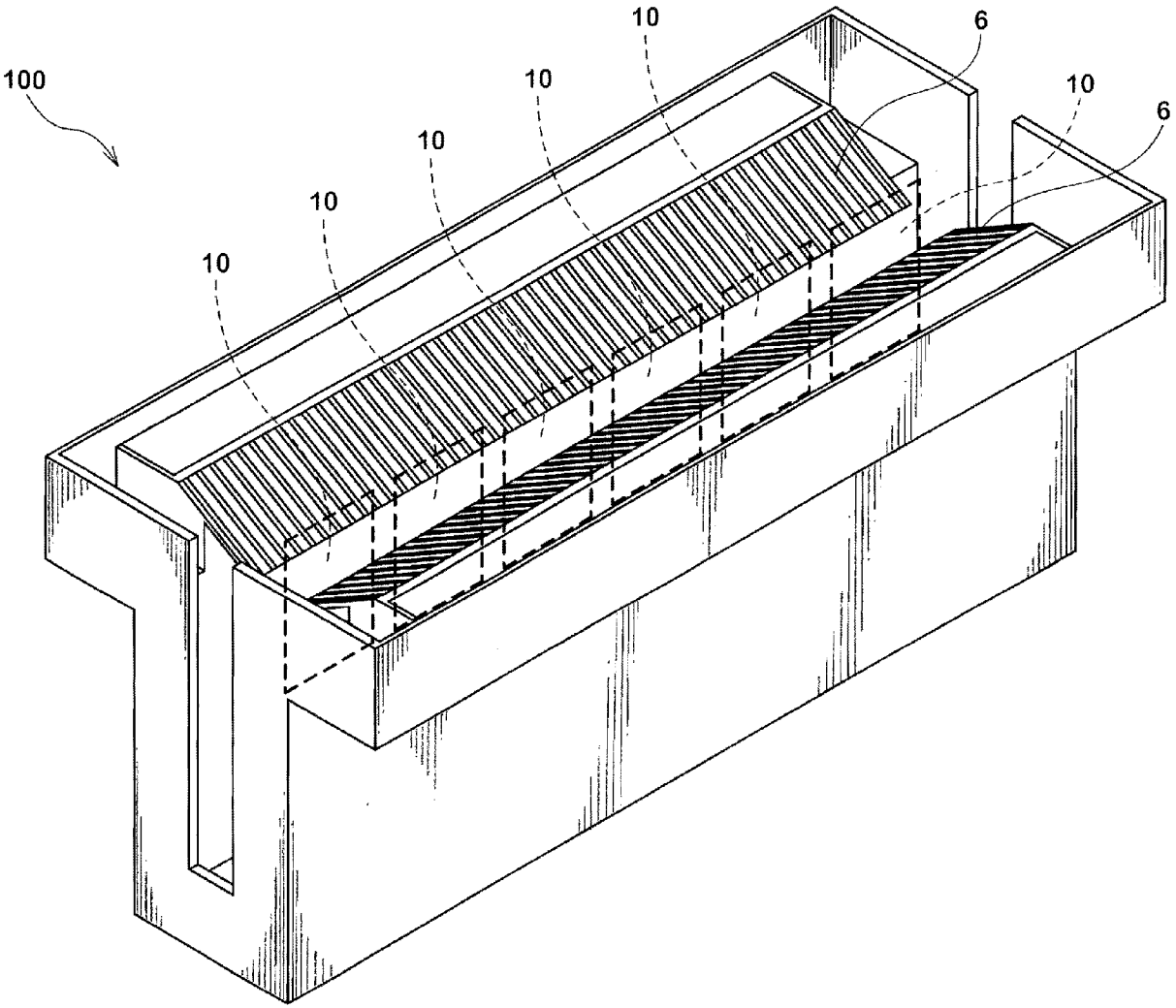
FIG. 13 is a perspective view of tank body according to another embodiment.

In the above embodiments, a width of the liquid outflowing part 6 is designed so as to meet the width of the plate-like work 10. However, as shown in FIG. 13, the width of the liquid outflowing part 6 may be designed so that processing solution Q is applied to the plural plate-like works 10 simultaneously inside of the tank body 100.

In the above embodiments, for leak prevention of the processing solution Q from slit 8, side wall 2*b* of the liquid receiving part 2 are arranged at a distance from both ends of the liquid outflowing part 6 (FIG. 4). However, side wall 2*b* of the liquid receiving part 2 may be arranged close to the both ends of the liquid outflowing part 6.

Figure 20:
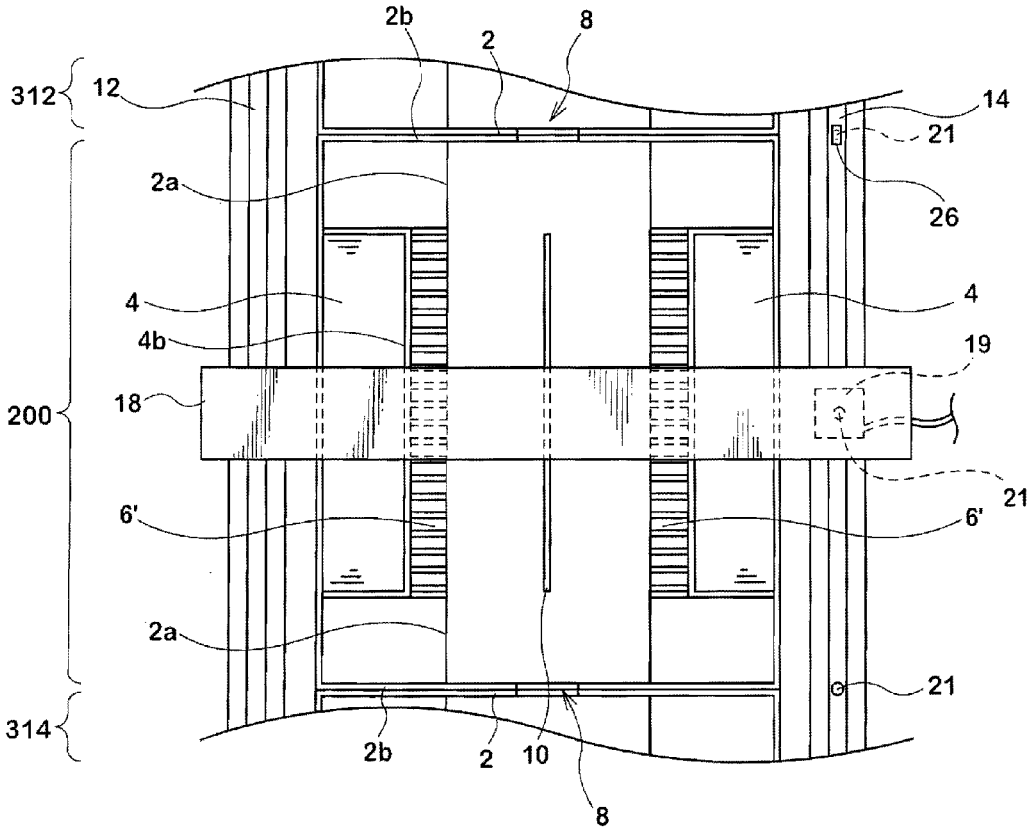
FIG. 20 is a view of the electroless copper plating tank 200 seen from above according to another embodiment.

In the above embodiments, a tip 6*a* of the liquid outflowing part 6 is projected from the connecting part 5 connecting to side wall 4*a* of the liquid retaining part 4 (or side wall 2*a* of the liquid receiving part 2) toward the plate-like work 10, and side wall 2*b* of the liquid receiving part 2 is arranged at a distance from the both ends of the liquid outflowing part 6 (FIG. 4). However, as shown in FIG. 20, the structure (liquid downflow member 6') that tip 6*a* of the liquid outflowing part 6 is not projected from the connecting part 5 connecting to side wall 4*a* of the liquid retaining part 4 (or side wall 2*a* of the liquid receiving part 2) toward the plate-like work 10 may be adopted, and side wall 2*b* of the liquid receiving part 2 may be arranged at a distance from the both ends of the liquid downflow member 6'.

In the above embodiments, the convex part 26 (FIG. 7B) is merely formed on guide rail 14. However, the convex part 26 may be formed on both of guide rails 12, 14

In the above embodiments, it makes an impact by means of the convex part 26 (FIG. 7B) arranged on the guide rail 14. However, it may make an impact by means of the other structure (for example, by forming concave portion, and so on).

Figure 18:
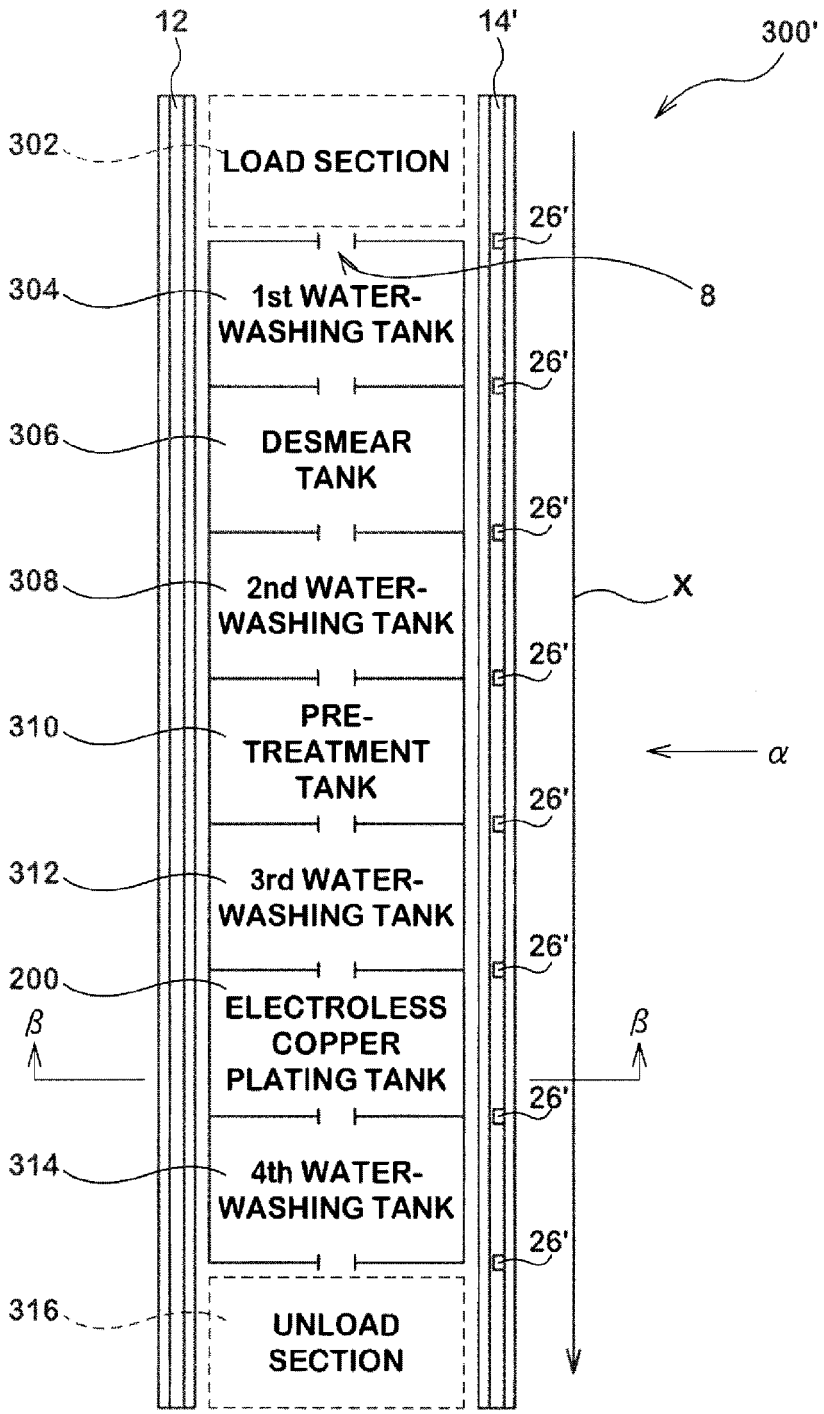
FIG. 18 is a arrangement plan of a surface treating apparatus 300' seen from above according to another embodiment.

In the above embodiments, one convex part 26 is arranged on the guide rail 14 (FIG. 7B). However, as shown in FIG. 18, plural convex parts 26' may be arranged on the guide rail 14. Also, convex part 26(FIG. 7B) is arranged between the 3rd water-washing tank 312 and the electroless copper plating tank 200 (FIG. 1). However, the convex part 26 may be arranged at the other position.

In the above embodiments, transport roller 24 is controlled so as to move back and forth on the convex part 26 (FIG. 7B). However, it may be controlled so as to merely pass over the convex part 26 without moving back and forth. For example, the transport roller 24 (FIG. 7B) may be controlled so as to move on the plural convex parts 26 that are arranged on the guide rail 14.

In the above embodiments, the transport roller 24 is controlled so as to move back and forth on the convex part 26 3 times. However, it may be controlled so as to move back and forth until meeting a predetermined condition (for example, it is detected that smear, or bubble has been removed from the plate-like work 10 by taking a image with camera and performing an image recognition, and so on.).

In the above embodiments, by operating the circulation pump 50 continuously, the plate-like work 10 is transported inside of the tank body 100 and carried out outside of the tank body 100 with flowing the processing solution Q from the liquid outflowing part 6 consistently. However, it may be controlled so as to flow the processing solution Q from liquid outflowing part 6 by powering on the circulation pump 50 when the plate-like work 10 is under suspension, or so as not to flow the processing solution Q from liquid outflowing part 6 by powering off the circulation pump 50 when the plate-like work 10 is in motion.

In the above embodiments, PVC is used as a material of tank body 100. However, the other may be used (for example, PP, FRP, PPS resin, PTFE, stainless-steel, etc.).

In the above embodiments, electroless copper plating is performed on the plate-like work 10 in the surface treating apparatus 300. However, the other electroless plating may be performed on the plate-like work 10 (for example, electroless nickel plating, electroless tin plating, electroless gold plating, etc.).

Figure 14:
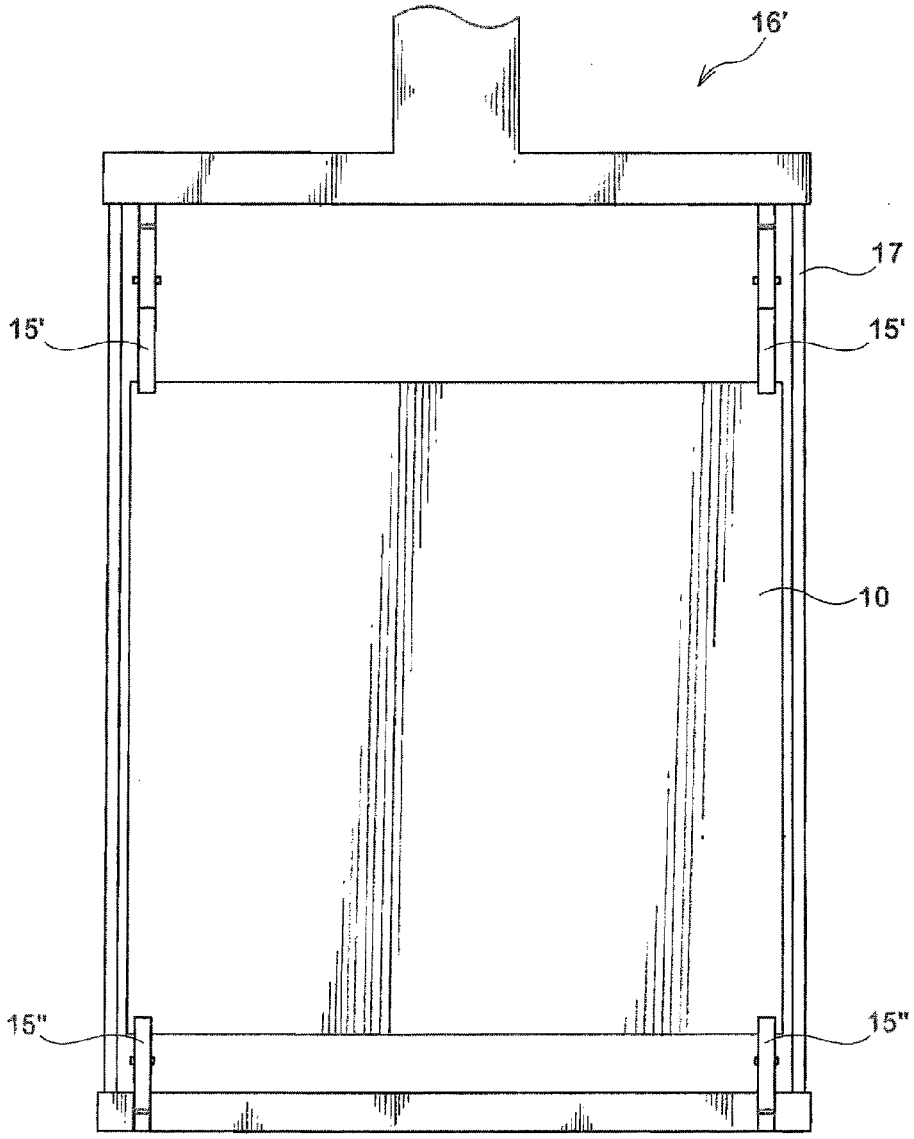
FIG. 14 shows a structure of the transport hanger 16' according to another embodiment.
Figure 15:
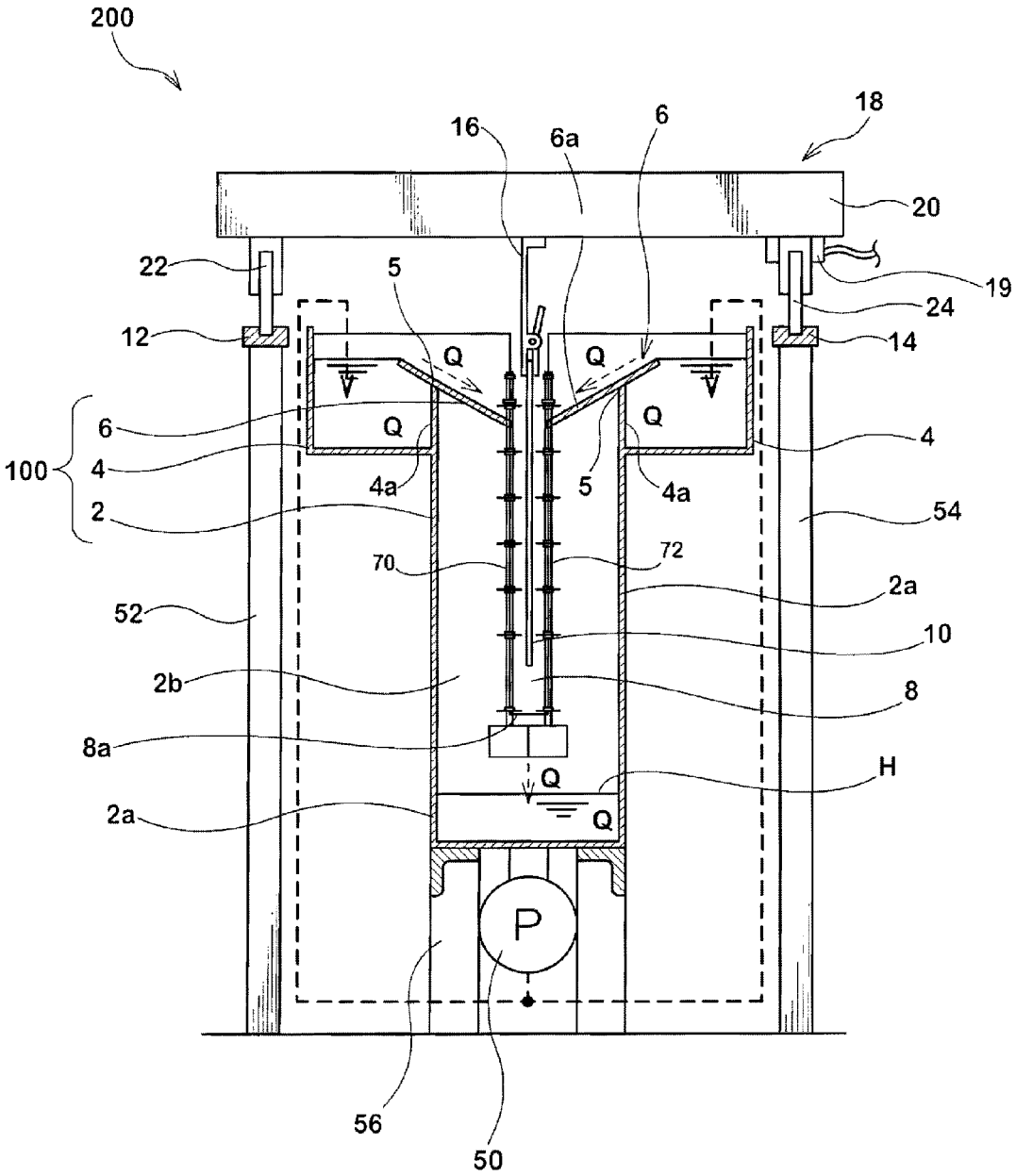
FIG. 15 shows a transport assist device according to another embodiment.
Figure 16:
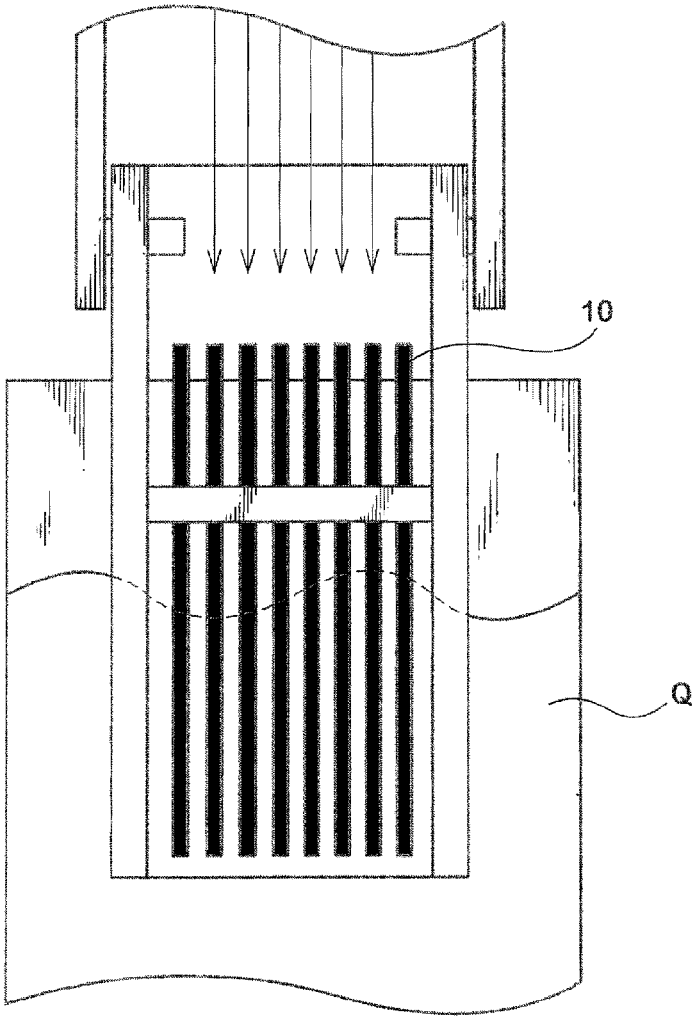
FIG. 16 shows an electroless plating process of a related art.
Figure 17:
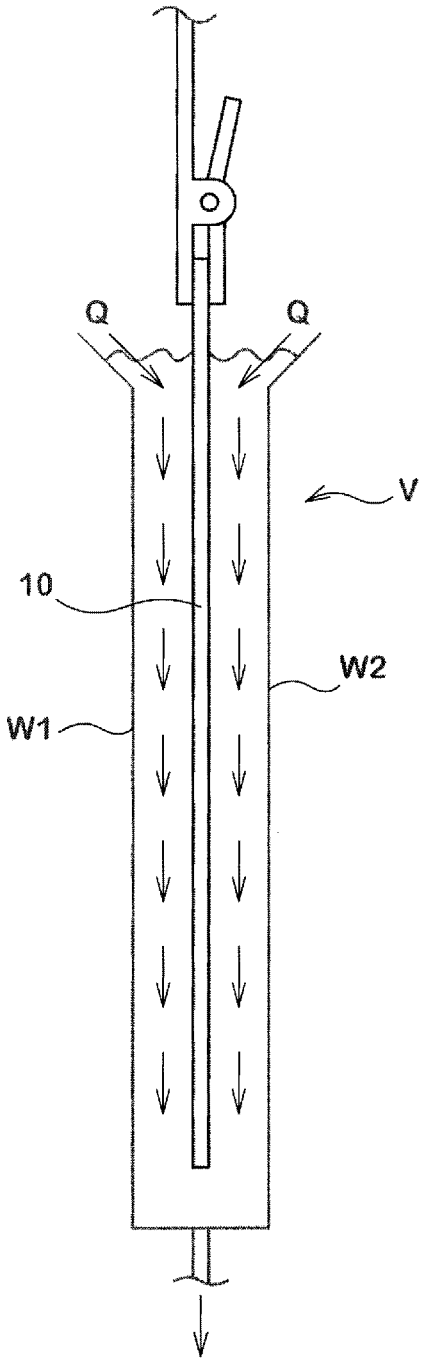
FIG. 17 shows a treatment tank V of a related art.

In the above embodiments, the transport hanger 16 clamps only upper end of the plate-like work 10 (FIG. 2). However, lower part of the plate-like work 10 may be weighted, or both upper end 15' and lower end 15" of the plate-like work 10 may be clamped by means of the transport hanger 16' attached to a flame body 17, as shown in FIG. 14. Also, as shown in FIG. 15, it may be transported with preventing from swinging of the plate-like work 10 when transporting by attaching rotary roller stands 70, 72 subsidiarily near the slit 8 inside of the tank body 100 that restricts the movement of the plate-like work 10.

In the above embodiments, the transport hanger 16 is transported by means of transport rollers 22, 24 of the transport mechanism 18 powered by a motor. However, the transport hanger 16 may be transported by means of the other driving method such as a pusher, a chain, and a linear motor system.

In the above embodiments, processing solution Q is applied to both sides of the plate-like work 10 (FIG. 6B). However, processing solution Q maybe applied to only one side of the plate-like work 10.

In the above embodiments, a predetermined location on the guide rails 12, 14 is detected by means of the magnetic sensor. However, the predetermined location may be detected by means of the other sensor (such as a bar-code reader, etc.).

In the above embodiments, the treatment object is formed as a rectangular plate-like work 10. However, the treatment object may be formed in other shape (such as a stick, a cube, etc.).

What is claimed is:

1. A surface treating apparatus, comprising:

a transport hanger for transporting a treatment object;

a tank body for attaching processing solution to the treatment object which is transported by the transport hanger interiorly; and a transport mechanism for transporting the transport hanger into the tank body, wherein the tank body includes a liquid receiving part for receiving the processing solution applied to the treatment object and a liquid retaining part placed at a position higher than the liquid receiving part for retaining liquids to be applied to the treatment object and a liquid outflowing part for causing a flow of the processing solution which is spilled out of the liquid retaining part and traveled down toward the treatment object, wherein a tip of the liquid outflowing part is projected from a connecting part connecting to the liquid retaining part or the liquid receiving part, and wherein the liquid outflowing part has grooves on the upper surface and extending toward the treatment object.

2. The surface treating apparatus according to claim 1, further comprising a guide rail for transporting the transport hanger in a nearly horizontal direction, wherein the transport hanger is controlled by a control part so as to move back and forth a predetermined number of times on an impact generator arranged on the guide rail.

3. The surface treating apparatus according to claim 1, further comprising a guide rail for transporting the transport hanger in a nearly horizontal direction, wherein the transport hanger is controlled by a control part so as to move on plural impact generators arranged on the guide rail.

4. The surface treating apparatus according to claim 1, further comprising plural guide rails for transporting the transport hanger in a nearly horizontal direction, wherein the transport hanger is fixed to a support member suspended between plural guide rails.

5. The surface treating apparatus according to claim 1, wherein the surface treating apparatuses are adjacently arranged in plural rows perpendicular to the direction of transport, the guide rail is shared between adjacent surface treating apparatuses.

6. The surface treating apparatus according to claim 1, wherein the liquid receiving part and the liquid retaining part are connected through a circulation pump.

7. The surface treating apparatus according to claim 1, wherein the liquid receiving part has a cutout vertically-extended on its side wall and the treatment object passes through the cutout when the transport hanger is transferred, wherein the processing solution are supplied to the liquid retaining part so that liquid level of the processing solution stored in the liquid receiving part is located below lower end of the cutout.

* * * * *